United States Patent [19]

Herrmann, Jr.

[11] 4,116,521

[45] Sep. 26, 1978

[54] MINIATURE UNIVERSAL CONNECTOR MODULE

[75] Inventor: Henry Otto Herrmann, Jr., Mt. Joy, Pa.

[73] Assignee: AMP Incorporated, Harrisburg, Pa.

[21] Appl. No.: 818,798

[22] Filed: Jul. 25, 1977

Related U.S. Application Data

[63] Continuation-in-part of Ser. No. 731,180, Oct. 12, 1976, abandoned.

[51] Int. Cl.[2] ..... H01R 13/52

[52] U.S. Cl. ..... 339/60 R; 339/94 C

[58] Field of Search ..... 339/59–63, 339/94, 206 R, 206 P

[56] References Cited

U.S. PATENT DOCUMENTS

| | | | |
|---|---|---|---|
| 2,333,266 | 11/1943 | Miller | 339/206 R |
| 2,897,471 | 7/1959 | De Tar | 339/94 R |
| 3,727,172 | 4/1973 | Clark | 339/59 M |
| 3,963,295 | 6/1976 | Askman | 339/60 R |

FOREIGN PATENT DOCUMENTS

| | | | |
|---|---|---|---|
| 2,522,499 | 12/1975 | Fed. Rep. of Germany | 339/60 R |

*Primary Examiner*—Joseph H. McGlynn
*Attorney, Agent, or Firm*—Russell J. Egan

[57] ABSTRACT

The disclosure relates to a miniature electrical connector having a rigid dielectric socket portion and an elastomeric tubular body sealably connected both inside the socket and over an insulated conductor, a thin internal flange of the elastomeric body being elastically folded and stretched to an elongate body being elastically folded and stretched to an elongate sleeve form grippingly engaging a longitudinal section of the insulated conductor preventing withdrawal thereof from the elastomeric body.

9 Claims, 4 Drawing Figures

MINIATURE UNIVERSAL CONNECTOR MODULE

CROSS REFERENCE TO RELATED APPLICATION

The present application is a continuation-in-part of my application Ser. No. 731,180 filed Oct. 12, 1976, now abandoned.

BACKGROUND OF THE INVENTION

1. The Field Of The Invention

The present invention relates to a sealed miniature electrical connector.

2. The Prior Art

There has been a long existing need for an electrical connector of minimum diameter and length to allow mating electrical connections for small gauge electrical leads carrying high voltage at low current. One such lead typically is of 20 gauge wire with a 0.08 O.D. diameter Teflon insulation jacket. Such an electrical lead is capable of carrying 10KV at low current. The problem in the prior art has been to design a connector of sufficient miniature size having a minimum number of component parts for ease in assembly and for eliminating voltage leakage paths caused by manufacturing tolerances in the interfaces between assembled parts. Yet the connector must have at least some parts which must be coupled together to provide for positive attachment to and retention of the electrical lead.

SUMMARY OF THE INVENTION

The connector according to the present invention satisfies requirements for miniaturization, eliminates leakage paths created by interface tolerances and provides for positive retention of the electrical lead. A rigid dielectric portion of the connector provides the connector mating face as well as a rigid mounting for an electrical contact with which the electrical lead is terminated. An elastomeric tubular body forms a gas tight seal when connected to the rigid body. The elastomeric body yields elastically for compression in sealed, gas tight encirclement over a substantial longitudinal portion of the insulation jacket. A thin internal web integral with the elastomeric body is yieldingly stretched elastically to an elongate sleeve form grippingly encircling the insulation jacket and providing retention of the same within the elastomeric body. The connector assembly and a means for lead retention is accomplished with a minimum number of component parts.

Accordingly it is an object of the present invention to provide an electrical connector having a minimum number of miniaturized component parts assembled into a gas tight assembly capable of withstanding high voltage.

Another object is to provide an electrical connector of miniature size utilizing an elastomeric tubular body which yields elastically to form a gas tight radial seal encircling an insulation jacket of a conductor, the tubular body having an integral internal web which is yieldingly folded and stretched elastically to a sleeve form encircling the insulated conductor and preventing removal thereof from said tubular body.

Another object of the present invention is to provide an electrical connector of miniature size fabricated from a minimum number of component parts in the form of an elastomeric body which establishes a gas tight seal with a rigid body and also with an insulated conductor, the elastomeric body further having an elastically foldable and stretchable web which grips the insulated conductor locking the same in the assembly.

Other objects and many advantages of the present invention will become apparent from the following detailed description taken in conjunction with the accompanying drawings.

DETAILED DESCRIPTION OF THE PREFERRED EMBODIMENT

Figure 2:
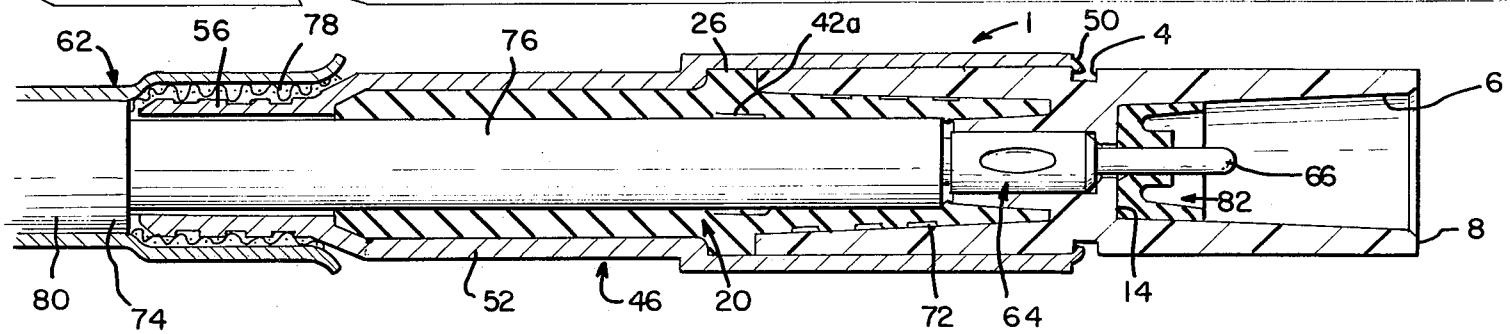
FIG. 2 is an elevation in section of the component parts of FIG. 1 assembled together with an electrical lead to form a completed connector module, and further illustrating changes in relative dimensions of the component parts when assembled together.

A connector module generally as indicated at 1 in FIG. 2 includes a rigid molded dielectric body generally indicated at 2 which is provided with an external annular groove 4 in its cylindrical periphery. The body 2 has a hollow interior, defined in part by a forward facing tapered recess 6 communicating with a forward end 8, serving as a rigid mating face for the connector module 1, and a rearward facing tapered recess 10 communicating with a rearward end 12. An internal wall 14 transversely of the cylindrical axis of the body 2 is molded integral with the body portion 2 and separates the recesses 6 and 10. A frusto-conical bushing or boss 16 integral with the wall 14 projects into the recess 10 and is concentric with the longitudinal cylindrical axis of the body 2. The boss includes a concentric stepped bore 18 therethrough which extends through the wall 14 allowing communication between the recesses 6 and 10.

The connector module 1 further includes a molded tubular body generally indicated at 20 of elastomeric dielectric, such as silicone rubber. A forward end portion 22 of the body 20 is provided thereover with a series of annular projecting external ribs 24 which are spaced apart and integral with the forward portion 22. The ribs are generally curviform in cross-section. Approximately midway of its length the body 20 is provided with an integral externally projecting flange 26 of relatively short, right cylindrical section. A space 28 is defined between the flange 26 and the nearest adjacent rib 24. The purpose of the space 28 will be explained hereinafter. The rearward end 30 of the body 20 is generally of right cylindrical configuration. The body 20 has a hollow interior which is defined by a generally cylindrical central bore or aperture 32 therethrough. At a forward end 34 of the body 20 a generally frusto-conical counterbore 36 is provided coaxially with the bore 32. At a rearward end 38 the body 20 is provided with a relatively short frusto-conical counterbore 40 defining a flared entryway for the bore 32. The body 20 further includes an internal, relatively thin web 42 radially joined to and integral with the tubular body 20 and initially transversely bridging across the hollow interior of the body. The web 42 is provided through its relatively thin thickness with a reduced diameter central aperture 44 along the longitudinal central axis of the hollow interior.

The connector module 1 further includes a generally stepped, sleeve form, metal shell generally indicated at 46 and provided with a generally enlarged right cylindrical forward end portion 48, in turn, provided with a reduced thickness lip 50. A mid-portion 52 of the shell 46 is of reduced right cylindrical configuration defining an internal annular shoulder 54 at the junction of the cylindrical portions 48 and 52. A rearward end 56 of the shell 46 is of further reduced, right cylindrical configuration with a shoulder 58 defined at the junction of the cylindrical portions 52 and 56. The external cylindrical surface of the portion 56 is provided with a series of spaced annular grooves 60.

The module 1 further includes a generally cylindrical metal ferrule generally indicated at 62 which is of a malleable material and which is relatively thin for radially inward deformation thereof, as will be described. A receptacle version of the connector module includes an electrical contact 64 having a forward end in the form of an elongated blunted pin 66 integral with a relatively larger barrel 68 which is radially indented at selected locations such as shown at 70 for crimped attachment to an electrical conductor 72 of an electrical lead generally shown at 74. Further details of the electrical lead are illustrated in FIG. 2 which will be described hereinafter. The lead 74 includes a Teflon insulation jacket 76 which intimately encircles the conductor 72. The jacket is covered with metal braid or shielding 78, which in turn is covered by an outer dielectric jacket 80.

An interfacial seal 82 of dielectric material completes the components for the connector. The seal 82 includes a cylindrical outer portion 84 and a coaxial cylindrical inner portion 86 integrally connected by radial web 88 at the rearward end of the seal. A bore 90 through inner cylindrical portion 86 includes a rearwardly directed frusto-conical counterbore 92.

Figure 1:
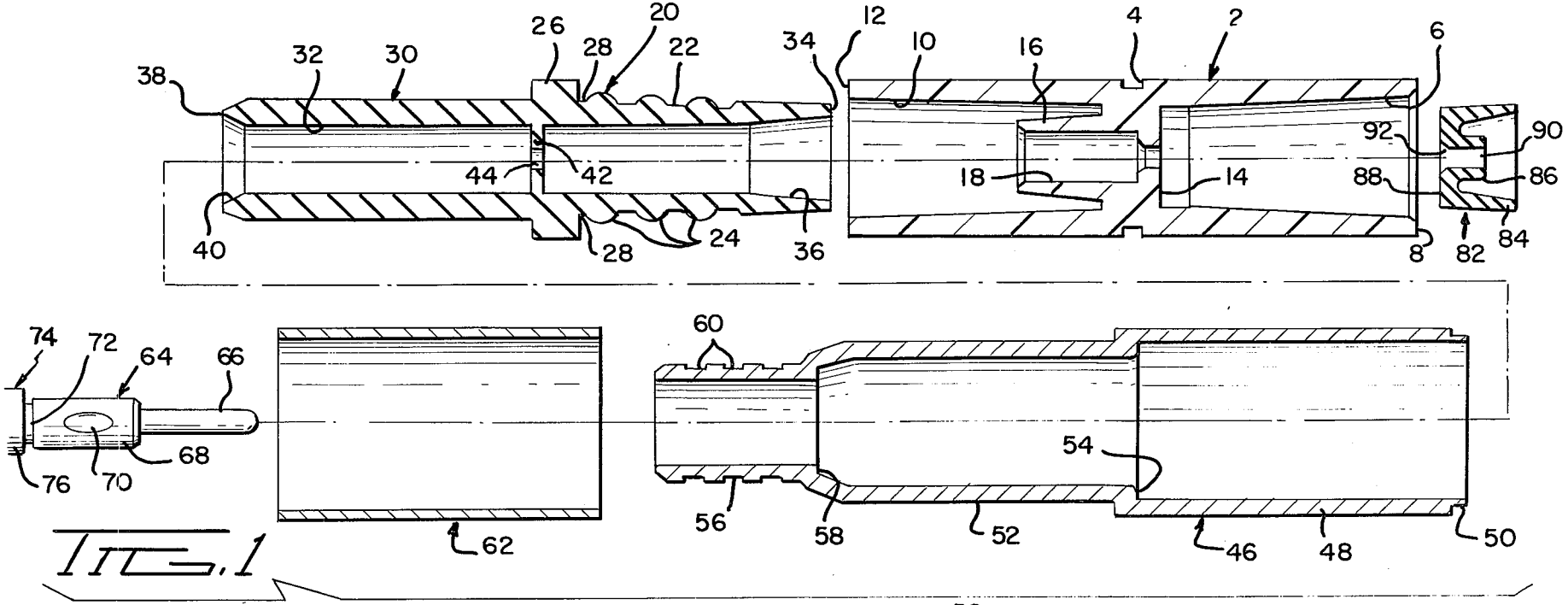
FIG. 1 is an elevation in section illustrating the component parts of the connector module according to the present invention, the parts being in exploded configuration to illustrate the original relative dimensions thereof prior to assembly.

FIG. 1 illustrates the sequency by which component parts of the connector module 1 are arranged prior to assembly. The elastomeric body 20 is inserted within the recess 10, the forward end 34 encircling the boss 16. It should be here noted that the forward end 34 of the elastomeric body is longer and thinner than the annular recess 10 formed between boss 16 and body 2. However, the forward end 34 and recess 10 are of equal volume and thus create a taper seal therebetween. Then the shell 46 is slid freely over the elastomeric body 20 and the body 2 in a direction from left to right, as shown in FIG. 1, so as to encircle the rearward portions of the elastomeric body 20 and rigid dielectric body 2. The lip 50 of the shell 46 is then inwardly staked or otherwise deformed to project radially inward into the groove 4 of the rigid dielectric body 2, securing the component parts together as shown in FIG. 2. The lead 74 terminated with the contact 64 subsequently is freely inserted through the ferrule 62 and then freely through the hollow interior of the shell 46. The insulation jacket 76 is then inserted through the hollow interior of the elastomeric body 20 with the contact 64 in registration within the stepped bore 18. The braid or shielding 78 of the electrical lead is positioned over the end portion 56 of the shell 46. The ferrule 62 is positioned to concentrically overlie the braid 78 and that portion of the lead 74 which is adjacent to the shell end portion 56. The ferrule 62 then is radially inwardly deformed or crimped to its configuration shown in FIG. 2 to provide a metal-to-metal contact between the shell end portion 56 and the braid 78, the grooves 60 of the shell body wedgingly receiving the braid 78 to insure the metal-to-metal relationship. To complete the assembly a dielectric interfacial seal 82 is inserted over the pin 66 of contact 64 and is seated in recess 6 against the wall 14.

The interfacial seal 82 is made of a compliant material which requires relatively little force to achieve a substantial amount of distortion. The seal also has relatively large sealing surface areas which, together with the easy distortion of the seal, serves to provide better sealing between the contact 64 and the wall 14 of the body 2.

Figure 3:
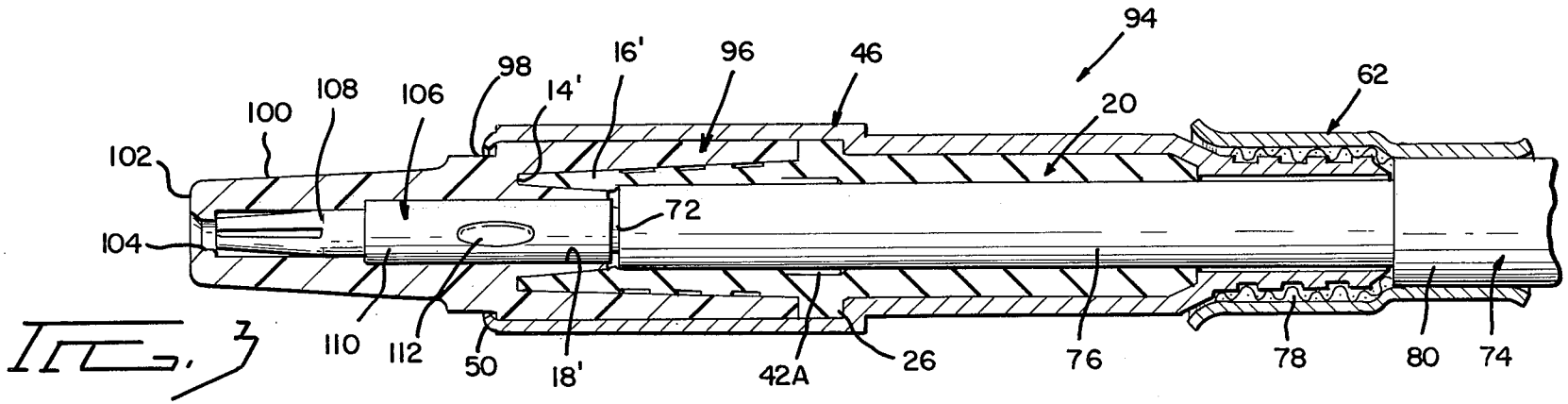
FIG. 3 is an elevation in section illustrating a receptacle form of a connector module matable with the connector module of FIG. 2.

FIG. 3 illustrates, generally at 94, a connector module of the plug type for mating with the receptacle type connector module shown in FIG. 2. As shown in FIG. 3, a rigid dielectric body 96, corresponding to the dielectric body 2, is provided with a stepped outer diameter 98 immediately behind a forward end portion 100 in the form of a tapered nose configuration, the forward end 102 of which serves as a rigid mating face and is provided with a central recess 104 of a size adapted to receive the pin 66 of contact 64 therethrough when the mating faces of the connector modules 94 and 1 are mated together. The connector module 94 further includes an electrical contact 106 of the receptacle type having a forward end portion 108, in the form of an electrical receptacle, disposed in alignment with the recess 104 and provided with a barrel portion 110 which is indented at 112 for crimped connection to a conductor 72 of an electrical lead 74 which is similar in construction to the lead 74 illustrated in FIG. 2. An elastomeric tubular body 20 and the metal shell 46, shown in FIG. 3 are of the same construction as the body 20 and the metal shell 46 shown in FIG. 2. The lip 50 of the shell 46 is radially inwardly deformed to overlie the stepped shoulder 98 to insure connection thereof to the rigid dielectric body 96, whereby the assembled parts are secured together.

Figure 4:
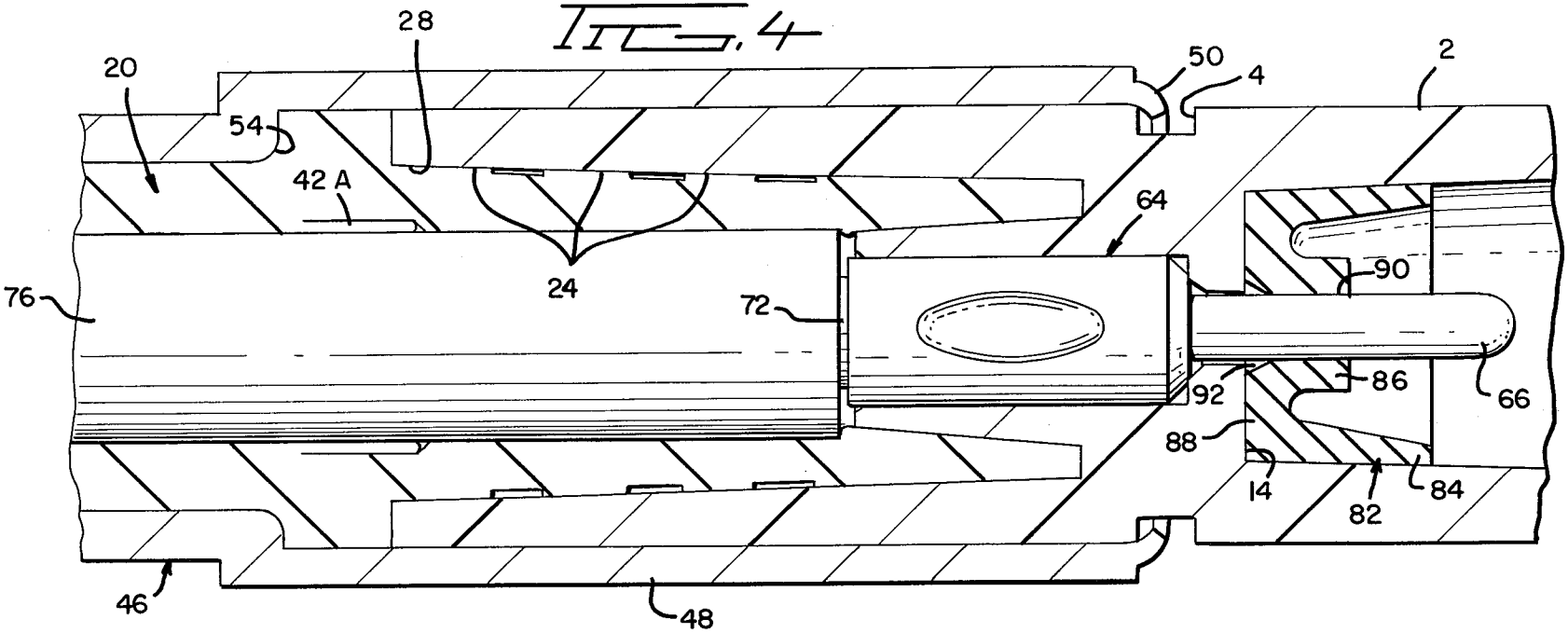
FIG. 4 is an enlarged fragmentary elevation in section of a portion of the connector module of FIG. 2.

FIG. 4 illustrates the behavior of the elastomeric dielectric body 20 upon assembly into the connector modules 1 or 94. As the insulation sheath or jacket 76 of the electrical lead 74 is inserted through the hollow interior of the elastomeric body 20, the body yields elastically and expands radially outward, exerting a residual encircling elastic radial grip on the insulation jacket to provide a gas tight seal over a substantial section of length thereof. The insulation jacket also is inserted through the central aperture 44 of the web 42. The web yields resiliently allowing radial expansion of the web aperture to allow passage therethrough of the insulation jacket. As the insulation jacket is forcibly inserted through the web aperture, from left to right in FIG. 4, the web 42 is also elongated, by elastic stretching, into a sleeve form. This is accomplished by elastically folding the web out of its transverse plane, upon traverse of the insulation jacket through the web aperture, and progressing the elastic fold along the web as it progressively is forced by the insulation jacket out of its transverse plane and into a sleeve form. The elastic fold is finally located at the junction of the web with the interior of the body 20 when the web assumes its full sleeve form 42A as shown in FIGS. 2 to 4. The sleeve form 42A is characterized by one cylindrical end at the junction thereof with the interior of the elastomeric body 20, and being elastically folded adjacent the junction and extending from left to right to a cylindrical free end, having an opening defined by the expanded web aperture. Since the web is elastically elongated when in its sleeve form, a corresponding reduction in its thickness occurs, as shown by comparing the sleeve form of FIG. 2 to the original web shape shown in FIG. 1. The sleeve form web exerts a residual radial elastic grip encircling a short cylindrical section of the insulation jacket 76 to form a gas tight seal thereover. The elastomeric body elastically yields radially outward to accommodate the sleeve form web and resiliently grips the same to form a gas tight seal thereover. The expanded body 20 thus forms a gas tight sheath intimately and compressibly encircling the length of the sleeve form web and also longitudinal sections of the insulation jacket on either side of the sleeve form web. The sleeve form web is radially in compression, externally by the body and internally by the insulation jacket, and is prevented thereby from returning to or otherwise being reformed, by retracing the progression of the elastic fold, to the original shape as shown in FIG. 1. In addition, the grip of the sleeve form web on the insulation jacket is sufficient to prevent slidable withdrawal of the insulation jacket. The web in its sleeve form thus retains the insulation jacket within the body, anchoring the same against rearward withdrawal.

When the body 20 is inserted in the rigid dielectric body 2 the contact 64 becomes seated in the stepped bore of the bushing or boss 16. The boss serves as a rigid mounting for the contact 64. The boss is received within the forward end 34 of the elastomeric body 20. The forward end 34 of the body 20 is longer and thinner than the annular recess 10 between boss 16 and body 2. However, the forward end 34 and recess 10 have substantially the same volume. The body 20 yields elastically when forcibly inserted in the rigid dielectric body 2 and is thereby in compression, internally by the insulation jacket and the boss, and externally by the rigid body, forming gas tight taper seal therewith.

The external ribs 24 are radially inwardly compressed by the rigid body 2. The ribs yield elastically to form resilient gas tight seals against the rigid body hollow interior. The elastomeric material of which the body 20 is fabricated flows elastically into the spaces between the ribs 24 relieving stresses in the material to prevent undesired deformation to occur in the material which would adversely deform or otherwise affect the desired gas tight seals.

The web 42 is initially radially overlied by the flange 26 as shown in FIG. 1. As shown in FIGS. 2 and 4, the flange 26 radially overlies the web 42 also in its sleeve form 42A to provide an enlarged overlying radial thickness of elastomeric material which yields elastically to relieve stresses at the folded junction of the web 42 and elastomeric body 20, and to accommodate or make way for the thickness of the sleeve form without causing undesired stressing and deformation of the body 20. As an added measure, the space 28 is provided, into which elastic flow of dielectric material is permitted, in order to relieve stresses in the elastomeric material. The free end of the sleeve form web 42A projects longitudinally outward beyond the flange and is therefore radially in alignment with the space 28. Elastic deformation of the body in encirclement over the web free end will have its internal stresses relived by elastic flow into the space 28. As shown in FIG. 4, the space 28 is partially filled with elastically flowed material. It is not critical that the space 28 or the spaces between ribs 24 be filled completely with elastically flowed elastomeric material. A wide range of variation in the amount of flow is permissible. Therefore the spaces between the ribs and space 28 serve as tolerance take-ups between the assembled parts assuring the desired gas tight seals are formed free of internal stresses which would deform them or otherwise adversely affect their effectiveness. The mean free path lengths through the air entrapped in the spaces between ribs 24 and space 28 are effectively short and are sealed off by the stress free gas tight seals, preventing voltage leak paths along the junctions of the component parts.

What has been described and shown are preferred embodiments of the present invention. Other embodiments and modifications thereof which would be apparent to one having ordinary skill in the art are intended to be covered by the spirit and scope of the appended claims.

What is claimed is:

1. An electrical connector, comprising:

a rigid dielectric body, a molded tubular body of elastomeric dielectric having hollow interior provided with an integral web which is joined to said tubular body, said web having an initial configuration bridging across said hollow interior, said web having a central aperture therethrough, an electrical lead having a central conductor provided thereover with an insulation jacket, a portion of said conductor being received in the hollow interior of said tubular body, said tubular body yielding elastically radially outward upon receipt of said insulation jacket in the hollow interior thereof, said tubular body exerting a residual elastic radial grip on said insulation jacket to form a gas tight seal thereover, said electrical lead being received through the central aperture of said web, said web being stretched elastically to an elongate sleeve form encircling and elastically gripping a section of said insulation jacket to form a gas tight seal thereover, said sleeve form web extending longitudinally of said hollow interior of said tubular body, said tubular body elastically yielding radially outward to accommodate said sleeve form web, said tubular body forming a gas tight sheath intimately and compressibly encircling the length of said sleeve form web and a longitudinal section of said insulation jacket which is disposed in said tubular body and which is immediately adjacent said sleeve form web, said sleeve form web being radially in compression externally by said tubular body and internally by said insulation jacket to prevent reformation of said sleeve form web to its original configuration, said rigid dielectric body including a hollow interior, a wall internally of said dielectric body and extending transversely of said hollow interior thereof, a boss integral with said wall and projecting concentrically within said hollow interior, said boss having a concentric bore therethrough communicating with a forward end portion of said rigid dielectric body, a forward end portion of said tubular body yieldably elastically engaged in the hollow interior of said rigid dielectric body forming a gas tight seal therewith, said forward end of said tubular body encircling said boss to form a gas tight seal therewith, said conductor of said electrical lead being connected to an electrical terminal mounted in said bore of said boss, and means securing together said tubular body and said rigid dielectric body.

2. The structure as recited in claim 1, and further including:

an external radial flange integral with said tubular body and providing a relatively thick radial section of elastomeric material overyling a junction of said web and said tubular body, said relatively thick radial section yielding elastically to stress relieve said junction when said web is stretched to said sleeve form, a flange being engaged against a rearward end portion of said rigid dielectric body.

3. The structure as recited in claim 1, wherein, said sleeve form web is elastically folded at one end which is joined integral with said tubular body and includes an opposite free end thereof extended longitudinally toward said forward end of said tubular body, said tubular body compressing said folded one end substantially eliminating any space between said tubular body and said folded one end.

4. The structure as recited in claim 3, wherein, said tubular body includes an integral external radial flange providing a thickened radial section of elastomeric material overlying said folded one end of said tubular body and which yields elastically to relieve the deformation stress at a junction of said sleeve form web and said tubular body.

5. The structure as recited in claim 4, wherein, said forward end of said tubular body includes a plurality of spaced integral external ribs which yield elastically in engagement against said hollow interior of said rearward end of said rigid dielectric body, and further including: a spaced defined between said external flange and one of said external ribs, said section of said tubular body which overlies said sleeve form web yielding elastically and expanding radially outward into said space to relieve deformation stresses within itself.

6. The structure according to claim 4, wherein, said flange elastically yields radially outward to encircle said web in its elastically stretched sleeve form concentric with said flange.

7. The structure according to claim 6, wherein, said web in said sleeve form has a free end extending longitudinally forwardly of said flange, said tubular body radially outwardly yielding immediately adjacent said flange.

8. The structure according to claim 1 further comprising:

an interfacial seal having outer and inner concentric cylindrical members integrally joined at one end by a radial web, said outer cylindrical member being received in the hollow interior of said rigid dielectric body, said electric terminal passing through said inner cylindrical member, and a mating connector member being received between said cylindrical members in compression thereby forming gas tight seals therebetween.

9. The structure according to claim 8 further comprising:

a rearwardly directed, frusto-conical entry to said inner cylindrical member, and said seal is made of compliant dielectric material requiring little force to effect great distortion.

* * * * *